United States Patent [19]

Hallford

[11] Patent Number: 4,472,690

[45] Date of Patent: Sep. 18, 1984

[54] UNIVERSAL TRANSISTOR CHARACTERISTIC MATCHING APPARATUS

[75] Inventor: Ben R. Hallford, Wylie, Tex.

[73] Assignee: Rockwell International Corporation, El Segundo, Calif.

[21] Appl. No.: 387,984

[22] Filed: Jun. 14, 1982

[51] Int. Cl.[3] ..... H01P 5/00

[52] U.S. Cl. ..... 333/35; 333/263

[58] Field of Search ..... 333/33, 35, 238, 246, 333/263

[56] References Cited

U.S. PATENT DOCUMENTS

| | | | |
|---|---|---|---|
| 2,794,174 | 5/1957 | Arditi et al. | 333/33 |
| 2,897,460 | 7/1959 | La Rosa | 333/33 |
| 3,104,363 | 9/1963 | Butler | 333/246 |
| 3,613,035 | 10/1971 | Askew | 333/246 |
| 3,693,118 | 9/1972 | Presser | 333/238 X |
| 3,925,740 | 12/1975 | Steensma | 333/238 X |
| 4,186,352 | 1/1980 | Hallford | 333/238 X |

OTHER PUBLICATIONS

Horton, *Crossovers In Microstrip,* Electronics Letters, 2/16/78, vol. 14, No. 4, pp. 110, 111.

Moreno, *Microwave Transmission Design Data,* Dover Publ., N.Y., 1948, p. 82.

*Primary Examiner*—Paul Gensler

*Attorney, Agent, or Firm*—Bruce C. Lutz; V. Lawrence Sewell; H. Fredrick Hamann

[57] ABSTRACT

Microstrip transistor characteristic matching apparatus is illustrated which can be altered as to design frequency, phase of reflection signal coefficient and magnitude of reflection coefficient to optimize signal transmission to or from a given transistor. After adjustment, the apparatus can be analyzed to quickly determine the characteristics required for an in-circuit commercial version of such a device.

6 Claims, 8 Drawing Figures

UNIVERSAL TRANSISTOR CHARACTERISTIC MATCHING APPARATUS

THE INVENTION

The present invention is generally related to electronics and more specifically related to microstrip signal transmission. Even more specifically, the present invention is directed toward a universal type transformer which can be used for optimizing signal transmission relative a microstrip or stripline circuit and an in-circuit transistor, such as a field effect transistor (FET).

The prior art approach to matching transistor characteristics to transmission lines has comprised the addition of open or shorted stubs formed by strips of metal attached to the conductor and/or by using different width transmission lines to change the transmission line impedance. Both of these approaches use fixed conductor patterns and require matching chips or stubs to be judiciously attached to the conductor and comprise a labor intensive project which requires extreme customization of each circuit manufactured. This customization is required because of the variation in characteristics of transistors of a given type. The present invention and the invention in a co-pending application having Ser. No. 338,291 filed on the same day as the present application, approach the solution of the problem of customization. The aforementioned co-pending application provides for a simple adjustment of the *angle* of reflection coefficient and the present invention attacks the problem of adjusting the *magnitude* of the reflection coefficient.

The magnitude of the reflection coefficient in the present disclosure is adjusted by placing a transformer element adjacent to or juxtaposed but non-ohmically connected to a transmission line whereby a sudden change in impedance or discontinuity in impedance characteristics is obtained in the transmission line. This causes an impedance mismatch that is used to terminate a transistor with its optimum voltage standing wave ratio (VSWR) which, in the art, is equatable to a characteristic termed "reflection coefficient magnitude". The length of this transformer element is designed to be one-quarter wavelength for optimum performance. The present invention provides design concepts for altering both the reflection coefficient magnitude and the optimum or design frequency of the impedance matching means.

It is thus an object of the present invention to provide an improved method of matching transistor characteristics to transmission line optimized impedances.

It is a further object of the invention to provide a simple solution to determining the correct reflection coefficient magnitude for a given transistor.

Other objects and advantages of the present invention may be ascertained from a reading of the specification and appended claims in conjunction with the drawings wherein:

Figure 7:
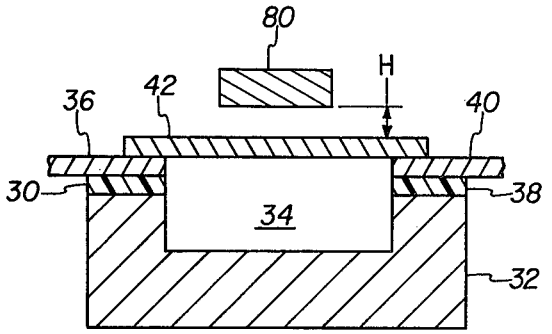
Figure 8:
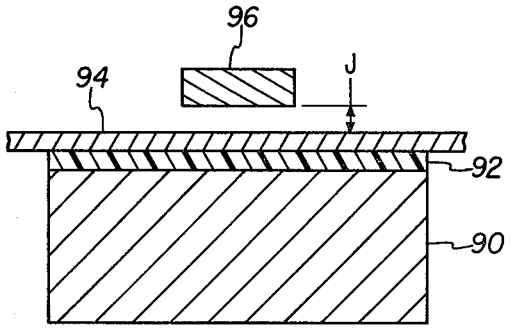

FIG. 7 is an alternate approach to the inventive concept where the transformer element or impedance lowering means is situated above the recessed portion of the ground plane; and FIG. 8 is a cross sectional view of the inventive concept where there is no recessed portion in the ground plane but the impedance lowering device is still situated near the transmission line to provide a change in signal reflection coefficient magnitude.

DETAILED DESCRIPTION

Figure 1:
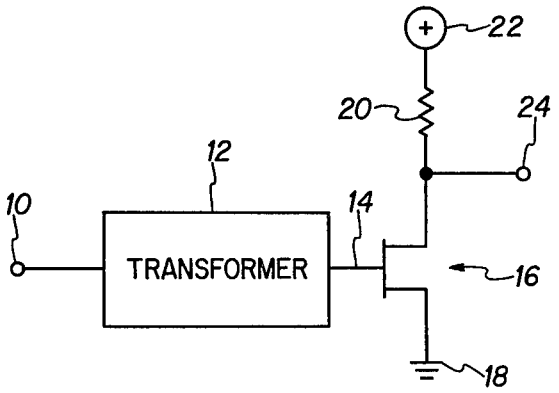
FIG. 1 is a schematic diagram of a transistor used in combination with an impedance transforming device for adjusting reflection coefficient magnitude and/or frequency.

In FIG. 1 an input terminal 10 supplies signals to a transformer or other impedance matching block 12 which supplies signals via a lead 14 to the input transistor lead which would be a gate for an FET semiconductor device 16. Semiconductor device 16 will normally be a field effect transistor (FET) having a source (drain) connected to ground 18 and a drain (source) connected through a resistor 20 to a positive power potential 22. If the FET 16 is an N channel type transistor, the source will be connected to ground 18 and the drain will be connected to the resistor 20. However, the particular connection of the FET is not part of the inventive concept and will be apparent to anyone skilled in the art. A terminal 24 is shown for providing output signals from the drain lead of FET 16.

Figure 2:
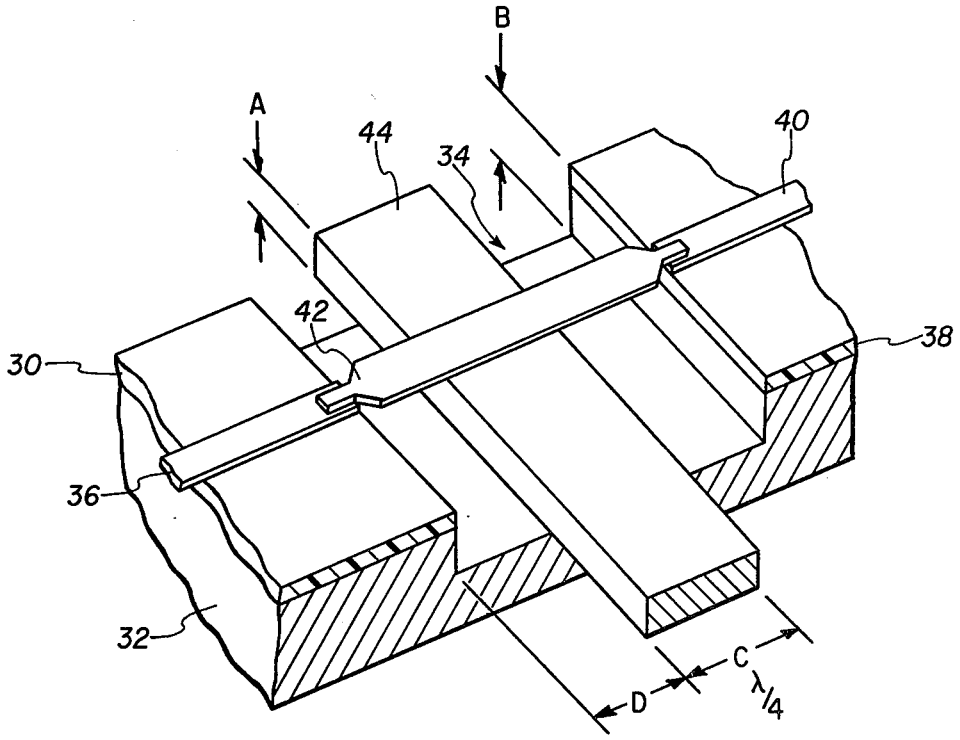
FIG. 2 illustrates an embodiment of the inventive concept with the transformer element in a recessed portion of the ground plane using a metallic material for the transformer element.

In FIG. 2 a dielectric 30 is shown on a ground plane 32 having a recessed, cavity or cutout portion 34 contained therein. On dielectric 30 is a portion of a transmission line or element 36. Another piece of dielectric 38 is shown on the opposite side of recessed portion 34 and another section of transmission line or element 40 is illustrated attached to the top surface of the dielectric 38. A portion of transmission line or element 42 spans or is suspended across the recessed portion and is connected between transmission element 36 at one end of the span and transmission element 40 at the other end. As illustrated, element 42 is constructed to a wider dimension than the elements 36 and 40 to compensate for the greater distance to the recessed portion of the ground plane wherein it will still have the same impedance until it reaches the vicinity of an impedance lowering element 44. As illustrated, dimension A is the thickness of element 44, dimension B is the distance between transmission element 42 and the recessed bottom portion of ground plane 32 and dimension C is the length of the element 44.

Figure 3:
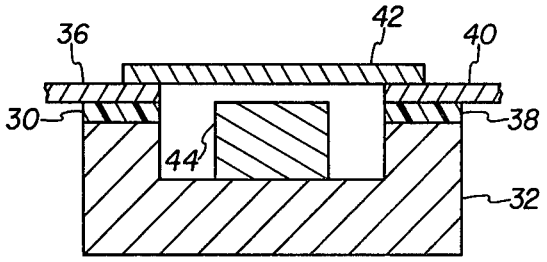
FIG. 3 is a cross sectional view of FIG. 2.

Since FIG. 3 is a cross section of FIG. 2 down the center line of the transmission lines 36, 40 and 42, the same numbers have been used throughout.

Figure 4:
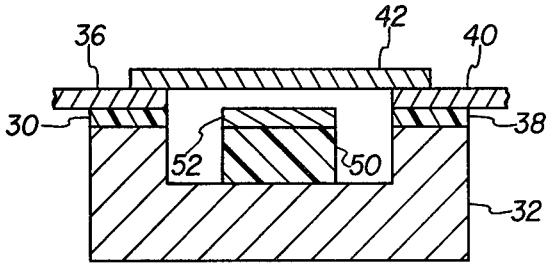
FIG. 4 is a cross sectional view using the same approach as FIG. 3 except that the transformer element comprises a piece of metal attached to a dielectric in place of the metal of FIG. 3.

In FIG. 4 the only change with respect to FIG. 2 or 3 is the fact that the impedance lowering device formerly designated as 44 now comprises a piece of dielectric 50 and a piece of metal on top thereof designated as 52. The distance between the top metallic layer 52 of the impedance lowering device in FIG. 4 to the transmission element 42 may be varied to obtain different reflection coefficient magnitudes.

Figure 5:
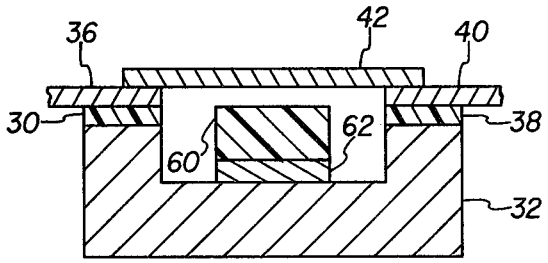
FIG. 5 illustrates a further approach where the dielectric of the transformer element is closest to the transmission line and metal is used below to change the height or distance from the ground plane to the transmission line.

In FIG. 5 the same numbers as used in FIG. 2 are again retained except a designator 60 for a dielectric portion of the impedance lowering means and a designator 62 for a metallic portion of the impedance lowering means which, in actuality, is primarily utilized to raise the ground plane or reduce the distance between the ground plane and transmission element 42.

Figure 6:
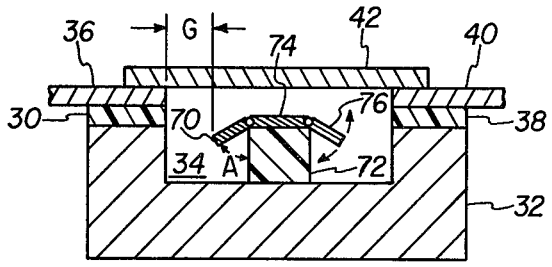
FIG. 6 illustrates a cross sectional view of the inventive concept wherein the length of the transformer element is changeable so as to affect the reflection coefficient magnitude and the design or optimum frequency of the impedance matching device.

In FIG. 6 a dimension G is illustrated which is the distance between the edge of the cavity 34 and the average distance to the edge of a hinged member 70 attached to an impedance lowering device 72 having an upper metal means 74 and a further hinged member 76. The hinged members 70 and 76 may traverse an arc of at least 90 degrees and perform useful variations in reflection coefficient magnitude and design frequency. An alteration in angle A of more than 90 degrees would not cause any beneficial effect for the purposes taught by this inventive approach.

In FIG. 7 the same numbers are again used as appropriate to FIG. 2 with the addition of an impedance lowering means 80 which is situated above the transmission element 42. A dimension H designates the distance between impedance lowering means 80 and the transmission element 42 with the base plane having a recessed portion 34 as previously illustrated.

In FIG. 8 a base plane 90 is shown having a dielectric material 92 attached thereto and a transmission element 94 on the upper surface of dielectric 92. An impedance lowering means 96 is illustrated at a height J above the transmission element 94.

OPERATION

As explained above and in my co-pending application, the reflection coefficient of a transmission line must be matched to a particular transistor amplifier in a high frequency semiconductor operation for a given frequency to obtain optimum performance. This matching must occur not only for the phase angle of the reflected signal as explained in my co-pending application but also must have a prescribed magnitude for optimum performance. The present invention discloses the method of changing the magnitude of the reflection coefficient as well as a method of changing the design frequency such that it is easy to obtain the values required for matching a transistor by empirical methods as opposed to the somewhat time-consuming approach of theoretical formulas or elaborate measurement methods. By using empirical methods, an optimum or near optimum match can be obtained at the transistor terminals and the resulting structure can be measured to determine what reflection coefficient values actually provide optimum amplification. The closer the matching structure is electrically to the transistor, the better the performance obtained.

The components of FIG. 2 illustrate the transformer or impedance matching apparatus listed as transformer 12 in FIG. 1. A discontinuity in the transmission line impedance is generated when the signal reaches the area defining the edge of impedance lowering element 44. Up to this point, the transmission line impedance is relatively constant. This is maintained constant from the extremes of conductor 42 to this point by widening the surface of the transmission line to compensate for the fact that the ground plane is further away than it is in the areas where the transmission line is designated as 36 or 40. The element 44 may be either dielectric or metal or a combination whereby the impedance between the transmission line 42 and the ground plane 32 is altered. The angle of the reflection coefficient is altered as explained in my co-pending application by changing the distance from the edge of cavity or recessed portion 34 to the edge of the element 44. The magnitude of the reflection coefficient is altered by changing the composition of arm 44 and its distance from transmission line 42. The design frequency for optimum operation is changed by altering the length of dimension C in FIG. 2.

FIG. 3 is a cross section showing as an example a given distance between the element 44 and the transmission line 42. This is a non-ohmic interaction and thus relies on capacitive and inductive effects to perform the lowering of the impedance.

As shown in FIG. 4, the use of dielectric 50 with a metallic layer 52 on top will change the reflection coefficient magnitude of any signals traveling on the transmission line. When the layer 52 is metal, precautions do need to be taken to prevent erratic ohmic contact with transmission line 42 since such ohmic contact will completely alter the operation of the transformer 12 as compared to operation immediately prior to such contact.

FIG. 5 illustrates raising the ground plane through the addition of the metal layer 62 on the ground plane 32. Further, the element 60 can be changed wherein different types of dielectric material may have different thicknesses or different dielectric constants. Each of these changes will alter the reflection coefficient magnitude. In other words, the distance from element 42 to the ground plane and the dielectric constant of the intervening material coact to affect the total reflection coefficient magnitude.

The combination material impedance lowering means of FIGS. 4 and 5 constitute a composite transformer element whose reflection magnitude coefficient effect is a complex variable and comprises an effective change in thickness or capacitive coupling for different combinations.

FIG. 6 illustrates a departure from FIG. 4 in that the element 74 is ohmically attached to the arms 70 and 76 by some type of hinge means and these arms are rotated from a vertical position to a horizontal position through a series of adjustments. Each different angle of adjustment will change the optimum frequency of operation since the design is such that the effective length of the element including any arms, will, for optimum performance, be one-quarter the wavelength of the transmitted frequency signal. As the arms are raised, the distance G is altered and thus the angle of the reflection coefficient is also changed. Thus, the base 72 of the impedance lowering element may need to be adjusted to maintain the right reflection coefficient angle for a given transistor as the frequency of operation is altered.

While previous illustrated embodiments have shown the impedance lowering element in a cavity or recessed portion, FIG. 7 illustrates that the impedance lowering element 80 can be placed outside the recessed portion and still provide a change in reflection coefficient magnitude. This magnitude change can be altered by changing any of (1) the distance H, (2) the thickness of dielectric element 80 and (3) the dielectric constant of element 80. Although element 80 in a preferred embodiment was a dielectric, it can be all or part metal and is illustrated as all metal in the drawing. Again, the design frequency is altered by changing the length of element 80 and the reflection coefficient angle is changed by altering the distance between the edge of recess 34 and the edge of element 80.

FIG. 8 illustrates that although a recessed portion or cavity such as 34 in FIG. 7 is desirable for some applications of this concept, the impedance lowering action will still occur in the embodiment of FIG. 8 and thus a given reflection coefficient angle, magnitude and design frequency will still be obtained without the depressed area. The magnitude will again be changed by a manner similar to that explained in FIG. 7 by adjusting the distance J, the thickness of element 96 and the composition thereof.

While I have shown many different approaches to designing a universal type reflection coefficient magnitude altering device for use with many different types of transistors or other semiconductor amplifying means with either microstrip or other transmission line devices, it is to be realized by those skilled in the art that there are many more approaches that can be delineated which would only unnecessarily add to the bulk of this disclosure. Therefore, I wish to be limited not by the specific embodiments illustrated but only by the scope of the appended claims wherein:

I claim:

1. Universal one-quarter-wave transformer apparatus including means for altering the reflection coefficient magnitude of a matched transmission line thereof comprising, in combination:

base ground plane means, including recessed portion means therein;

conductor means suspended over and traversing said recessed portion means of said base means and forming a part of a transformer apparatus said conductor means being widened over said recessed portion to maintain matched transmission line impedances in the absence of further elements; and impedance lowering means situated in said recessed portion means of said ground plane means the reflection coefficient magnitude of said conductor means being a function of the distance between said impedance lowering means and said conductor means.

2. Apparatus for achieving a given reflection coefficient magnitude in a quarter-wavelength transformer used in a microstrip circuit comprising, in combination:

ground plane means, including recessed portion means situated therein;

microstrip conductor means attached to but electrically insulated from said ground plane means and traversing said recessed portion means thereof in a suspended mode said conductor means being widened over said recessed portion to maintain matched transmission line impedances in the absence of further elements; and impedance lowering means juxtaposed said conductor means where it traverses said recessed portion means of said ground plane means the distance between said impedance lowering means and said conductor means affecting the reflection coefficient magnitude relative said conductor means.

3. A quarter-wavelength transformer used in a microstrip circuit comprising, in combination:

ground plane means, including recessed portion means situated therein and dielectric on the nonrecessed portions of one surface;

microstrip conductor means attached to said dielectric of said ground plane means at the ends of a suspended portion which traverses said recessed portion means thereof and in the absence of further elements has a constant impedance throughout;

impedance lowering means juxtaposed said conductor means where it traverses said recessed portion means of said ground plane means the frequency of operation being a function of the length of said impedance lowering means along the axis of said conductor means.

4. A quarter-wavelength transformer used in a microstrip circuit comprising, in combination:

ground plane means, including recessed portion means situated therein;

microstrip conductor means attached via dielectric means to said ground plane means at ends of a suspended portion which traverses said recessed portion means thereof said conductor means being widened over said recessed portion to maintain matched transmission line impedances in the absence of further elements; and impedance lowering means juxtaposed said conductor means where it traverses said recessed portion means of said ground plane means the reflection coefficient magnitude being a function of the thickness of said impedance lowering means and the distance between said impedance lowering means and said conductor means.

5. A quarter-wavelength transformer used in a microstrip circuit comprising, in combination:

ground plane means and associated dielectric means on one surface thereof, including recessed portion means situated therein;

constant impedance microstrip conductor means attached to said dielectric means of said ground plane means and traversing said recessed portion means thereof; and impedance lowering means juxtaposed said conductor means where it traverses said recessed portion means of said ground plane means, the optimum operation frequency being a function of the length of said impedance lowering means along the axis of said conductor means and the reflection coefficient magnitude and thus, the impedance being a function of the distance between said impedance lowering means and said conductor means.

6. Apparatus for altering the reflection coefficient magnitude of a quarter-wavelength transformer used in a microstrip circuit comprising, in combination:

ground plane means, including recessed portion means situated therein;

constant impedance microstrip conductor means;

means for attaching said conductor means to said ground plane means in areas other than said recessed portion and for suspending same over said recessed portion means of said ground plane means; and impedance lowering means juxtaposed said conductor means where it traverses said recessed portion means of said ground plane means.

* * * * *